US008323452B2

(12) United States Patent
Ruehl et al.

(10) Patent No.: US 8,323,452 B2
(45) Date of Patent: Dec. 4, 2012

(54) METHOD FOR OPTIMIZING THE ENERGY BALANCE IN FORMING SECTIONS IN MACHINES FOR THE PRODUCTION OF FIBROUS WEBS, AND FORMING SECTION USING CONTROL ELEMENTS ASSOCIATED WITH DEWATERING UNITS

(75) Inventors: Thomas Ruehl, Wernau (DE); Moritz Schmalenbach, Karlsruhe (DE); Volker Schmidt-Rohr, Heidenheim (DE); Marco Esper, Heidenheim (DE); Oliver Kaufmann, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/333,712

(22) Filed: Dec. 21, 2011

(65) Prior Publication Data

US 2012/0145346 A1 Jun. 14, 2012

Related U.S. Application Data

(60) Division of application No. 12/858,943, filed on Aug. 18, 2010, which is a continuation of application No. PCT/EP2009/059406, filed on Jul. 22, 2009.

(30) Foreign Application Priority Data

Jul. 24, 2008 (DE) ..... 10 2008 040 688

(51) Int. Cl.

| | |
|---|---|
| ***D21F 9/00*** | (2006.01) |
| ***D21F 3/10*** | (2006.01) |
| ***D21F 1/52*** | (2006.01) |
| ***D21G 9/00*** | (2006.01) |

(52) U.S. Cl. ..... 162/258; 162/263; 162/309; 162/358.1; 162/363; 700/128

(58) Field of Classification Search ..... 162/198, 162/263, 272, 308–309, 351–352, 358.1, 162/363, 252; 700/127–129
See application file for complete search history.

(56) References Cited

U.S. PATENT DOCUMENTS 3,040,807 A * 6/1962 Chope ..... 162/252
(Continued)

FOREIGN PATENT DOCUMENTS

CA 2276095 A1 * 12/1999
(Continued)

OTHER PUBLICATIONS

International Search Report dated Oct. 29, 2009 in PCT/EP2009/059406 ( 2 pages).

(Continued)

*Primary Examiner* — Jose A Fortuna
(74) *Attorney, Agent, or Firm* — Taylor IP, P.C.

(57) ABSTRACT

A forming section in a machine for producing a web of fibrous material includes a control and/or regulating system including a control and/or regulating device which is connected with at least one device for at least indirect acquisition of one value at least indirectly characterizing the dry content of the fibrous web in a transfer area from the forming section to a following function unit, with a device for input of a desired value for the target dry content, and with at least the control elements of an individual dewatering unit located prior to one of the last dewatering units, or the last dewatering unit inside the compression zone. The control and/or regulating device also includes a device for creating the control variables for controlling the individual dewatering units.

4 Claims, 8 Drawing Sheets

U.S. PATENT DOCUMENTS

| | | | | |
|---|---|---|---|---|
| 3,649,444 | A * | 3/1972 | Futch, Jr. | 162/198 |
| 5,045,153 | A | 9/1991 | Sollinger et al. | |
| 5,078,835 | A | 1/1992 | Schiel et al. | |
| 5,320,713 | A | 6/1994 | Bubik et al. | |
| 5,507,918 | A | 4/1996 | Polifke et al. | |
| 5,825,653 | A * | 10/1998 | Huovila et al. | 700/128 |
| 5,853,543 | A * | 12/1998 | Hu et al. | 162/198 |
| 6,086,716 | A * | 7/2000 | Watson et al. | 162/198 |
| 6,183,602 | B1 | 2/2001 | Iwata et al. | |
| 6,204,672 | B1 * | 3/2001 | Chase | 324/695 |
| 6,264,796 | B1 | 7/2001 | Simmons | |
| 6,267,846 | B1 * | 7/2001 | Halmschlager et al. | 162/203 |
| 6,274,002 | B1 * | 8/2001 | Rulis et al. | 162/352 |
| 6,319,362 | B1 * | 11/2001 | Huhtelin et al. | 162/198 |
| 6,328,851 | B1 * | 12/2001 | Huhtelin et al. | 162/198 |
| 6,361,657 | B2 | 3/2002 | McPherson | |
| 6,375,799 | B1 * | 4/2002 | Halmschlager et al. | 162/186 |
| 6,669,820 | B2 * | 12/2003 | Odell | 162/300 |
| 6,780,285 | B2 | 8/2004 | Leinonen et al. | |
| 6,855,230 | B2 * | 2/2005 | Salminen et al. | 162/198 |
| 6,993,408 | B2 * | 1/2006 | Puurtinen | 700/128 |
| 7,005,039 | B2 | 2/2006 | Bartelmuss et al. | |
| 7,067,042 | B2 * | 6/2006 | Moser et al. | 162/300 |
| 7,279,072 | B2 * | 10/2007 | Muhonen et al. | 162/258 |
| 7,318,882 | B2 * | 1/2008 | Niemi | 162/198 |
| 7,437,208 | B2 * | 10/2008 | Muench et al. | 700/128 |
| 7,833,386 | B2 | 11/2010 | Moser | |
| 2002/0043355 | A1 | 4/2002 | Ruf et al. | |
| 2002/0108732 | A1 * | 8/2002 | Grabsoheid et al. | 162/302 |
| 2002/0153113 | A1 | 10/2002 | Ruf et al. | |
| 2003/0188842 | A1 * | 10/2003 | Ronnenberg | 162/198 |
| 2003/0216828 | A1 * | 11/2003 | Puurtinen | 700/128 |
| 2004/0011488 | A1 * | 1/2004 | Salminen et al. | 162/198 |
| 2004/0045691 | A1 * | 3/2004 | Moser et al. | 162/301 |
| 2004/0188050 | A1 * | 9/2004 | Henssler | 162/208 |
| 2005/0006044 | A1 * | 1/2005 | Muhonen et al. | 162/198 |
| 2005/0145357 | A1 * | 7/2005 | Muench et al. | 162/198 |
| 2006/0157213 | A1 * | 7/2006 | Ronnenberg | 162/192 |
| 2008/0135197 | A1 | 6/2008 | Moser | |
| 2009/0199987 | A1 * | 8/2009 | Spindler et al. | 162/198 |
| 2011/0024069 | A1 * | 2/2011 | Ruehl et al. | 162/202 |
| 2011/0290442 | A1 * | 12/2011 | Wildfong et al. | 162/344 |
| 2012/0145346 | A1 * | 6/2012 | Ruehl et al. | 162/258 |

FOREIGN PATENT DOCUMENTS

| | | | |
|---|---|---|---|
| DE | 40 02 304 | A1 | 8/1991 |
| DE | 40 05 420 | A1 | 8/1991 |
| DE | 102005035558 | A1 * | 2/2007 |
| DE | 102008040948 | A1 * | 2/2010 |
| EP | 1063348 | A2 | 12/2000 |
| EP | 1426488 | A1 | 6/2004 |
| EP | 1454012 | B1 | 10/2006 |
| EP | 1137845 | B1 | 1/2008 |
| WO | 93/12292 | A1 | 6/1993 |

OTHER PUBLICATIONS

Written Opinion (undated) of International Searching Authority in PCT/EP2009/059406 (4 pages).

Office Action dated Dec. 29, 2008 of European Patent Office in Application No. 06 755 281.0-2314 (5 pages).

International Search Report dated Aug. 30, 2006 in PCT/EP2006/062511 (4 pages).

International Preliminary Report on Patentability dated Feb. 26, 2008 of International Searching Authority in PCT/EP2006/062511 (9 pages).

English translation of Written Opinion (undated) of International Searching Authority in PCT/EP2006/062511 (8 pages).

International Preliminary Report on Patentability dated Feb. 8, 2011 for PCT/EP2009/059406 (5 pages).

* cited by examiner

METHOD FOR OPTIMIZING THE ENERGY BALANCE IN FORMING SECTIONS IN MACHINES FOR THE PRODUCTION OF FIBROUS WEBS, AND FORMING SECTION USING CONTROL ELEMENTS ASSOCIATED WITH DEWATERING UNITS

CROSS REFERENCE TO RELATED APPLICATIONS

This is a division of U.S. patent application Ser. No. 12/858,943, entitled "METHOD FOR OPTIMIZING THE ENERGY BALANCE IN FORMING SECTIONS IN MACHINES FOR THE PRODUCTION OF FIBROUS WEBS, AND FORMING SECTION", filed Aug. 18, 2010, which is incorporated herein by reference. U.S. patent application Ser. No. 12/858,943 is a continuation of PCT application No. PCT/EP2009/059406, entitled "METHOD FOR OPTIMIZING THE ENERGY BALANCE IN FORMING UNITS IN MACHINES FOR PRODUCING FIBROUS WEBS AND FORMING UNIT", filed Jul. 22, 2009, which is incorporated herein by reference.

BACKGROUND OF THE INVENTION

1. Field of the Invention

The invention relates to a method for optimizing the energy balance in a forming section in a machine for the production of a fibrous web, especially a paper, cardboard or tissue web, whereby a fibrous stock suspension which is fed into the forming section through a headbox after having reached the immobility point is passed through at least two dewatering units inside one compression zone following the immobility point, to a transfer area to a following functional unit.

The invention further relates to a forming section, comprising at least one continuous wire supporting the fibrous stock suspension at least indirectly, and at least two dewatering units arranged in tandem or respectively arranged following each other in the direction of travel of the fibrous suspension inside the compression zone.

2. Description of the Related Art

The production of fibrous webs in a continuous manufacturing process occurs by forming of fibers from an aqueous suspension on a moving wire inside a forming section. Due to weight, water is removed from the suspension and from the web being formed, by means of mechanical compression, especially due to the wire tension at curved dewatering elements and with the assistance of vacuum suction through the wire. Following the dewatering process in the forming section the fibrous web is transferred to a press section in which additional water is removed from it. The web is subsequently transferred to a drying section where the drying process is completed.

Forming sections as components in a wet section of a machine for the production of fibrous webs are known in the current state of the art in a multitude of designs. Relative to their specific embodiment they are divided into single wire formers and twin wire formers. Hybrid formers represent a variation of a twin wire former with a Fourdrinier wire, whereby generally the lower wire acts as the Fourdrinier wire in the twin wire former. The essential purpose of these types of forming sections consists on one hand to achieve a targeted placement of the fibers adjacent to each other and on top of each other, as well as to achieve fiber orientation inside the fibrous suspension as desired and to further dewater the fibrous stock suspension during passage through the forming section in a way that, at the end of the forming section viewed in machine direction, a fibrous web which is characterized by an appropriately pre-defined dry content can be transferred to the subsequent processing sections, especially a press section. In order to ensure sufficient quality of the end product and to minimize reject end products the properties of the fibrous web must be continuously monitored during the production of fibrous webs, especially fibrous webs in paper or cardboard machinery. Various parameters can be used as control value in a control and/or adjustment in the production process, for example the basis weight, the water weight or also the thickness of a fibrous web in different segments inside the machine for the production of such a fibrous web. The final quality of the fibrous web is substantially influenced by processes in the forming section, for example by the formation. There are many control processes known in the current state of the art with which the quality of the fibrous web can be controlled inside the forming section through control of dewatering, revealing themselves for example in the formation, porosity, fiber orientation, the vertical sheet formation and moisture content.

An apparatus for the production of a fibrous web including a twin wire former which comprises conspiring wires which travel together over part of their rotational path by forming a so-called twin wire zone is already known from EP 1 426 488 A1. A measuring arrangement to measure one characteristic of the fibrous web in the area of, or around the twin wire zone is provided inside said apparatus, whereby the measured characteristic is fed into a control unit as an actual value and this control unit controls one production parameter for the production of the fibrous web. For example, the pressure level or vacuum in a dewatering unit inside a pre-dewatering zone is set as a control value. Based on a desired dry content of the fibrous web that was determined by the control unit, a dewatering unit located at the beginning of the pre-dewatering zone when viewed in direction of travel of the fibrous web can be used—in other words, even before the compression zone—in order to adjust the dry content of the fibrous web. The adjustment of a pre-defined formation is considered an essential objective.

A method for the operation of a forming section is already known from EP 1 454 012 B1 where the consistency of pulp inside a forming section, as well as the influence of the consistency over the formation and/or porosity of the developing fibrous web are determined and the consistency is adjusted on the basis of the quality properties of the finished fibrous web and/or though optimization of a cost function. The quality characteristic of the fibrous web is defined by its formation and/or the porosity. The cost function includes at least the costs which are conditional upon the required energy consumption and the required power supply.

A method and a system to regulate the cross profile of the stock dry weight in a fibrous web which is formed from a fibrous stock suspension in a forming section and which includes at least one continuous rotating water permeable wire is already known from EP 1 137 845 B1. Here, an actual value of the stock dry weight in the drying section is determined and based on a water weight cross profile which is determined by means of a water weight sensor inside the forming section, conclusions are made regarding an ensuing stock dry weight cross profile. The stock dry weight cross profile is regulated on the basis of the stock dry weight cross profile which was predetermined as a result of the water weight measurement.

Among other factors, all prior mentioned designs use the drainage capacity inside the forming section as the control value, whereby preferably pressures, especially partial vacuum at suction devices function as control values. In contrast EP 1 063 348 A2 offers a possibility of control/regulation of dewatering units in embodiment of forming blades.

The designs known from the current state of the art essentially meet the objective of controlling and/or of regulating the individual components of a forming section, or respectively their conspiring with each other in such a way that with regard to the result which is to be achieved relative to the ensuing material web, especially fibrous web, optimum properties of the desired kind are achieved. The cost aspect resulting from the energy balance of the entire line essentially is not considered here. As a rule, a favorable energy balance is contrary to the desired result, or in other words to achieving an appropriately high dry content after reaching the, or respectively passing through the, forming section. In many lines for example the vacuum which is to be supplied to the individual suction devices inside the forming section is preset to a firm value, whereby the high efficiency suction devices are often set to maximum vacuum during operation. The efficiency of dewatering is accordingly high. Due to the relative movement of the movable wire and the high-vacuum suction device, the wire—also because of high frictional forces—is subject to high wear and tear.

What is needed in the art is to develop a method for optimization of the energy balance in a forming section in such a way that even at a lower required energy supply into the forming section an optimum result regarding the required dry content is achieved, while not impairing the sheet formation. The fibrous stock suspension inside the forming section must be dewatered in an as energy saving and wear and tear preventing way as possible until the required dry content is reached.

SUMMARY OF THE INVENTION

The present invention provides a method for optimizing the energy balance in a forming section in a machine for the production of fibrous webs, especially paper, cardboard or tissue webs, whereby a fibrous stock suspension which is fed into the forming section through a headbox after having reached the immobility point is passed through at least two dewatering units inside one compression zone following the immobility point, to a transfer area to a following functional unit, characterized in that, depending upon a theoretical maximum dry content achievable during operational conditions in the transfer area where the fibrous web is transferred to a following functional unit, based on the available dewatering elements a desired value is predefined for an adjustable target dry content which is selected so that it is smaller than the theoretically achievable maximum dry content, but equal to or greater than a minimum dry content required in the area of the transfer area, and that the target dry content is controlled by reducing the incoming dry content on one of the last dewatering units viewed in direction of travel of fibrous stock suspension, preferably directly on the last dewatering unit inside the compression zone. The forming section can be equipped with an appropriate control and/or regulating device.

An inventive method for optimizing the energy balance in a forming section in a machine for the production of a fibrous web, especially a paper, cardboard or tissue web, whereby a fibrous stock suspension which is fed into the forming section through a headbox after having reached the immobility point is passed through at least two dewatering units inside one compression zone following the immobility point to a transfer area, to a following functional unit is characterized in that, depending upon a theoretical maximum dry content for a certain fibrous stock suspension achievable during operational conditions in the area where the fibrous web is transferred to a following functional unit, based on the available dewatering units a desired value is predefined for an adjustable targeted dry content which is selected so that it is smaller than the theoretical maximum dry content achievable under operational condition, but equal to or greater than a minimum dry content required in the area of the transfer area, and the target dry content is controlled in an especially advantageous design by reducing the incoming dry content at least on one of the last dewatering units, preferably directly on the last dewatering unit inside the compression zone.

Theoretically achievable dry content is to be understood to be the stock-dependent dry content of the fibrous web which is achievable under line conditions, especially maximum line conditions. The line conditions are characterized by process parameters of the operational mode of the individual dewatering units, as well as the entire forming section, especially by the speed of travel through the machine. They also include the drying time at the individual dewatering elements which is determinable as a function of the travel speed of the fibrous stock suspension through the machine, and the length of a respective segment of influence, as well as the process parameters of the individual dewatering devices/dewatering elements, especially pressures, or respectively partial vacuums. Stock-dependent in this context refers to the characteristics of the fibrous stock suspension which is to be dewatered, especially its composition, water content, etc.

This theoretic maximum achievable dry content is to be differentiated from the absolute maximum dry content which is consistent with the dry content after an infinite drying time in one, or respectively the individual drying elements, and cannot be translated into practical application.

The immobility point is to be understood to be the location inside a forming section where the individual fibers in the fibrous stock suspension are aligned in their positioning with each other and can no longer move relative to each other. This area also marks the beginning of the actual compression zone. In other words, no formation occurs in this area, only removal of fluid, especially water from the fibrous web which is being formed from the suspension.

In the context of the current invention, dewatering units are to be understood as being all stationary, movable or rotatable devices which enable dewatering of the fibrous stock suspension through application of forces, impulses and pressures, as well as vacuum. These include in particular suction devices in the form of stationary suction boxes, curved or straight guide elements such as forming boards, flat suction devices or rotatable rolls. The suction area is stationary, in other words in a fixed location and may be formed by one or several suction zones, extending in machine direction, and transversely to same across the entire width and which can be connected in-series, whereby the individual suction zones located in-series in machine direction can be engaged individually or in groups.

In an additional design it is also conceivable to divide the suction area into suction zones, transversely to machine direction, whereby they would also be controllable either individually or in groups.

The inventors recognized that based on the characteristic of the dewatering behavior of the fibrous stock suspension the outgoing dry content at the end of the dewatering unit is not directly proportional to the incoming dry content. Therefore, a greater outgoing dry content in the range of the theoretically achievable maximum dry content that can be reached under line conditions for the specific fibrous stock suspension can be adjusted also with a lower incoming dry content at the dewatering unit. This characteristic is used specifically for energy savings whereby the theoretically available output is not necessarily utilized at all individual dewatering units, but whereby only one of the last, preferably the last dewatering unit in the compression zone is designed and positioned so that it is suitable to achieve a very high or even the maximum drainage capacity under line condition. Therefore, operations occur with a very high or maximum possible energy supply, and therefore a maximum operational capacity, whereby at least one or several upstream dewatering units inside the compression zone are operated in a way that their theoretically achievable outgoing dry content is less than the maximum achievable one at full utilization of the available capacity. Because of this they can be operated with considerable lower energy supply and therefore lower capacity than is necessary to achieve the theoretically possible maximum dry content in conspiring with the last dewatering unit, so that two-digital percentages of air volume savings are possible with dewatering units in the embodiment of suction devices. At the same time the effect of the last dewatering unit inside the compression zone is increased, with the same operational parameters so that now here, based on the lower incoming dry content at the entry of the fibrous stock suspension/fibrous web the utilized energy supply leads to an increased drainage capacity and thereby also to an improvement of the lubricating effect due to the increased drainage volume. This makes it possible to utilize high efficiency suction devices as one of the last, or preferably the last dewatering unit, whereby their use without additional measures can provide low wear.

In order to achieve a stable operational mode in regard to the dry content in a forming section it is not absolutely essential to set the theoretical maximum dry content possible under line conditions in a forming section in the transfer area to the following functional unit. Instead it is sufficient, depending upon the operational and process conditions, to set a lower predefined minimum dry content that is dependent upon the fibrous stock suspension which is to be dewatered. In taking advantage of the knowledge regarding the drainage characteristic in a dewatering unit, an optimum overall dry content can then be achieved in the delivery from the forming section while at the same time lowering the required energy supply. Thereby, the individual dewatering elements can be operated considerably more effectively in regard to their energy balance. They require a substantially lower capacity, thereby markedly reducing operating costs.

The incoming dry content at the last dewatering unit can be set by controlling the drainage capacity on at least one of the dewatering units located prior to it inside the compression zone. In an especially advantageous variation it is operated with a lower output and therefore maximum possible drainage capacity.

In order to ensure a stable and continuous operational mode in a forming section in a machine for the production of a fibrous web, the target dry content is regulated. For this purpose an actual value of the target dry content after the last dewatering element in the compression zone is determined continuously or periodically. It is compared with the desired value and the individual control elements of the individual dewatering units are controlled depending upon the variance. The individual dewatering units located prior to the last dewatering unit in the compression zone act as control elements of this control system whose operating parameters act as regulating variable.

The target dry content which is to be set in the transfer area is selected to be in the range of 0.1 to 5%, especially preferably 0.1 to 3%, more especially preferably 0.1 to 2% of the theoretically achievable maximum dry content.

In regard to equipment the forming section in a machine for the production of fibrous webs includes at least one continuous rotating wire supporting the fibrous stock suspension at least indirectly, and at least two dewatering elements located in series, or respectively located following each other in direction of travel of the fibrous stock suspension inside a compression zone. In addition, a control and/or regulating system is provided including a control and/or regulating device which is connected with at least one device for at least indirect acquisition of one value at least indirectly characterizing the dry content of the fibrous web in a transfer area from the forming section to a following function unit; with a device for input of a desired value for the target dry content and with at least the control elements of an individual dewatering unit located prior to one of the last dewatering units, or the last dewatering unit inside the compression zone. The control and/or regulating device also includes a device for creating the control variables for controlling the individual dewatering units. As a device for at least indirect acquisition of one value characterizing the dry content of the fibrous web in a transfer area from the forming section to a following function unit a sensor can be used for direct acquisition or for the acquisition of a value relative to a functional connection with the dry content, or measuring of the drainage volume, for example through water weight sensors.

Controlling of a plurality of, and preferably of all, dewatering units occurs preferably through the control and/or regulating device so that it is linked with all control elements of the individual dewatering units. The individual dewatering unit can be in the embodiment of one of the following dewatering units:

- Suction device especially a fixed suction device or rotating suction couch roll;
- Forming box with at least one suction zone and forming blades, fixed or subject to pressing contact;
- Forming blades; or
- Curved dewatering element.

In an especially advantageous manner one of the last dewatering units, preferably the last dewatering unit of a forming section which has to be passed through is in the embodiment of a high efficiency vacuum suction device. The suction devices located prior to this can then be operated at substantially lower suction capacity at an only slightly reduced overall dry content. The inventive solution in regard to the energy savings potential is especially effective in those embodiments of dewatering units which include vacuum suction devices. However, use of other dewatering elements, for example adjustable forming blades where for example the contact pressure can be reduced, is also conceivable.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1A:
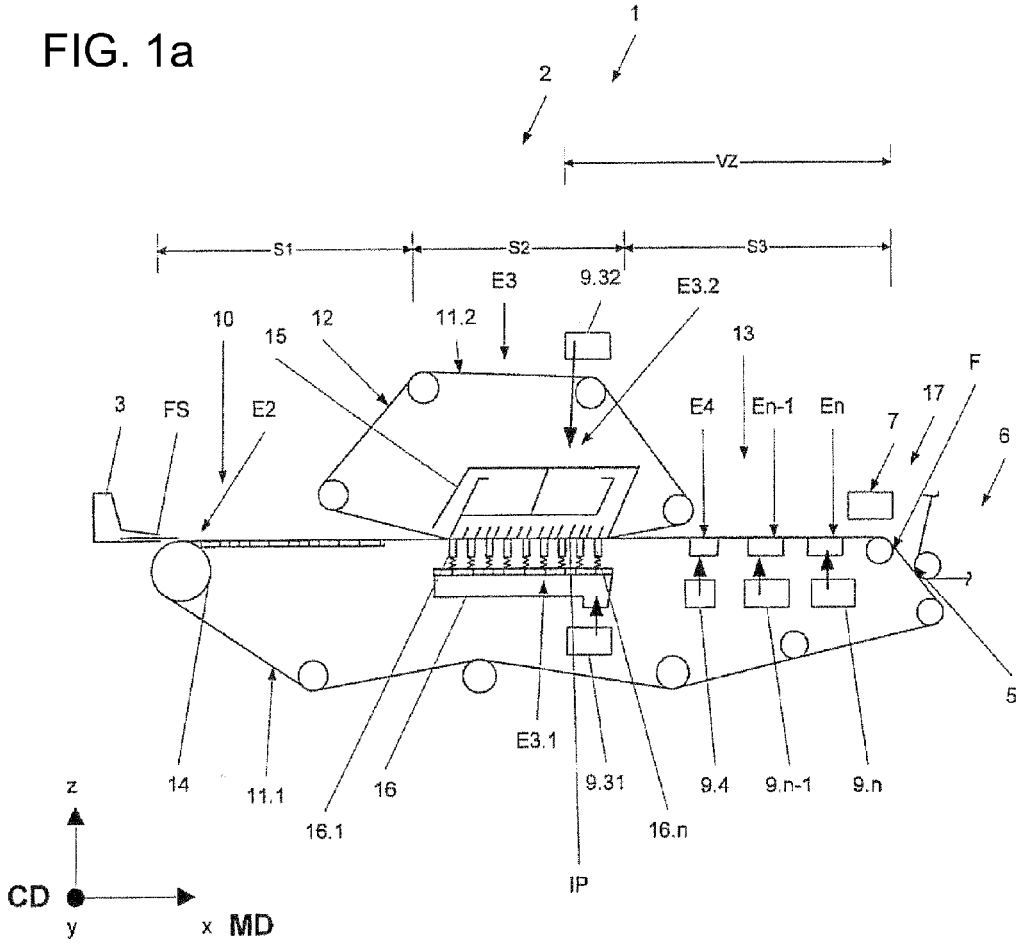
FIGS. 1*a* and 1*b* show a schematic simplified illustration of an inventive forming section and a control/regulating system allocated to same which illustrate an inventive method for controlling the dry content.
Figure 1B:
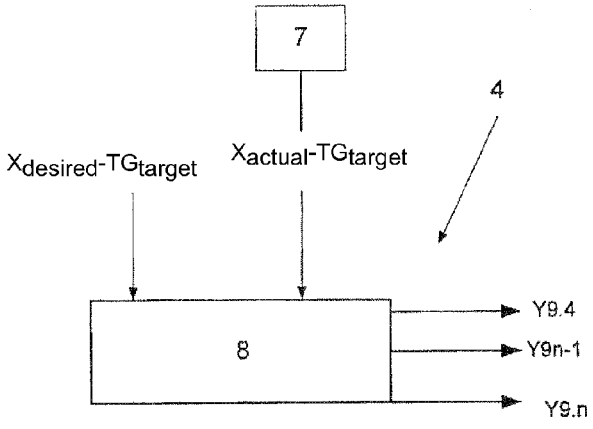

Referring now to the drawings, and more particularly to FIGS. 1*a* and 1*b*, FIGS. 1*a* and 1*b* clarify in a strongly simplified schematic view of an example of a forming section 1 and a control/regulating system 4 the basic principle of an inventive method for optimization of the energy balance inside the forming section 1 for a machine 2 for the production of fibrous webs, especially fibrous webs F in the embodiment of paper, cardboard or tissue webs. FIG. 1*a* shows a strongly simplified schematic of a forming section 1, prior to which a headbox 3 is located through which fibrous stock suspension FS is fed to forming section 1. A coordinate system is attached to forming section 1 for clarification of the individual directions. X-direction describes the direction of travel of the fibrous stock suspension FS and therefore the direction which is also referred to as MD in which the material web which was formed from said suspension travels through machine 2 for the production of fibrous webs. The direction vertical to this in the same horizontal plane describes the Y-direction which is consistent with the cross direction to machine direction MD and is known as CD-direction. Z-direction vertical to both previously described directions describes the vertical direction.

In forming section 1 the fibrous stock suspension FS is guided, filtered and thickened at least at one continuous rotating wire 11.1, in the illustrated example at least over a section between two continuous rotating wires 11.1 and 11.2 and after reaching a so-called immobility point IP is compressed in the following compression zone VZ. Between headbox 3 and a transfer area 5 where fibrous web F is transferred to a press section 6 which is located following forming section 1, forming section 1 in the current example in the embodiment of a hybrid former includes for example three dewatering segments S1 through S3 which are located behind each other and through which the fibrous stock suspension FS passes successively. They are constructed differently. The first dewatering segment S1 in direction of travel provides a so-called pre-dewatering zone 10. The following dewatering segment S2 is described as twin wire zone 12, while dewatering segment S3 provides an after-dewatering segment 13. Wire 11.1 is a component of all dewatering segments S1 through S3. In individual zones 10, 12 and 13 dewatering units E1 through En act at least indirectly on fibrous stock suspension FS. Inside pre-dewatering zone 10 a breast roll 14 is provided after headbox 3 in the first continuous rotating wire 11.1. Furnishing of fibrous stock suspension FS occurs directly onto a forming table as a dewatering unit E2 which is arranged in a horizontal plane of fibrous stock suspension FS and which is supported by the Fourdrinier arrangement provided by wire 11.1. Drainage occurs through dewatering segment S1 and thereby pre-dewatering zone 10. Fibrous stock suspension FS is further guided and drained over the second dewatering segment S2 which is provided by twin wire zone 12. Wire 11.1 is guided together with an additional second continuously revolving wire 11.2 in the embodiment of an upper wire over part of its revolving path, thus forming dewatering segment S2. At least one dewatering unit E3 is arranged in dewatering segment S2 acting on at least one of the wires, preferably on both wires 11.1 and 11.2 and the fibrous stock suspension FS being carried between them. Separation between first and second wires 11.1 and 11.2 occurs then after dewatering unit E3, whereby suction devices, for example in the embodiment of curved separation suction devices, may be provided to support the separation, or, dewatering unit E3 is equipped with an appropriate suction zone. Dewatering unit E3 consists of a dewatering chest 15 located in wire 11.2, and a forming box 16 located in the area of extension of dewatering chest 15, viewed in direction of rotation of wire 11.2. Dewatering box 15 and forming box 16 contain so-called forming blades, whereby the forming blades 16.1 through 16.*n* contained in forming box 16 are preferably positioned on the inside surface of wire 11.1 and pressed against same. The individual forming blades 16.1 through 16.*n* in forming box 16 can be pressed against the belt preferably individually or in groups. Forming blades 16.1 through 16.*n* are guided preferably individually and viewed in direction of wire travel are located behind each other, preferably parallel to each other, and extend across the machine width. Dewatering box 15 represents dewatering unit E3.2, forming box 16 through 16.*n* represents dewatering unit E3.1. The contact pressure of forming blades 16.1 through 16.*n* occurs via an adjustment device 9.31. Dewatering chest 15 and/or forming box 16 are also suction equipped, whereby, viewed in machine direction MD the suction can occur over one suction zone or several suction zones following each other and which are controllable individually or in groups. Immobility point IP for the fibers in the fibrous stock suspension FS occurs inside twin wire zone 12. This marks the point in machine direction where, based on the dewatering process, the fibers in the fibrous stock suspension FS are aligned in a way that their orientation will no longer change and their positioning relative to each other remains. Additional influences of dewatering units only lead to additional dewatering under compression which is why the function area following the immobility point is described as compression zone VZ. This area is provided inside dewatering segment S2 and extends over the width of forming unit 1.

Following twin wire zone 12 is after-dewatering zone 13 which includes dewatering units E4, En−1 and En which are located in series and following each other, whereby En is the last dewatering unit before transfer area 5. The individual dewatering units E4 through En can preferably be in the embodiment of suction devices. After-dewatering zone 13 is hereby formed by first wire 11.1. Forming section 1 therefore includes preferably a plurality of dewatering units E1 through En, acting in-series or parallel.

Before transfer area 5 the produced fibrous web F has a dry content G which is referred to as the final dry content in forming section 1. Generally this is preset and is consistent with dry content TG that is to be adjusted at the end of forming section 1. Depending upon line conditions, for example speed of the machine for the production of fibrous webs F and the selected dewatering units E1 through En as well as their operating parameters, theoretically a maximum final dry content $TG_{max}$ can be achieved for a certain fibrous stock suspension, that is a fibrous stock suspension having certain characteristics like composition, consistency, etc. at the end of forming section 1, especially in transfer area 5 or before it after the last dewatering unit En. This theoretic maximum dry content $TG_{max}$ for a certain fibrous stock suspension type is achieved when all dewatering units E1 through En are operated utilizing their maximum possible capacity at maximum possible reaction time. It has however been shown that by increasing only the energy supply and therefore the capacity of the individual dewatering units E1 through En, viewed over their reaction time does not necessarily achieve a corresponding drainage increase inside forming section 1. The inventors recognized that a lower dry content $TG_{target}$ deviating slightly from $TG_{max}$ in discharge area area 17 of forming section 1, which is in or prior to transfer area 5 following the last dewatering unit En, can also be achieved when the output of the individual dewatering units, especially those which are located before the last dewatering unit in direction of travel and located after immobility point IP (in this example E4 through En−1 with n element of the natural numbers not being consistent with the theoretically available maximum output), so that the theoretically available dewatering output on the last dewatering unit En can be fully utilized. A target dry content $TG_{target}$ for the fibrous web F is preset for discharge area 17 of forming section 1 which under line conditions deviates in a range of approximately 0.1 to 5%, preferably 0.1 to 3%, especially preferably 0.1 to 2% from the theoretically maximum achievable and stock-dependent dry content $TG_{max}$. This is set as desired value $X_{desired}$–$TG_{target}$. The ensuing current actual value $X_{actual}$–$TG_{target}$ at discharge 17 of forming section 1 is acquired by means of a device 7 for the at least indirect acquisition of a value describing the dry content TG at least indirectly. This device 7 is preferably allocated directly to the web guidance in discharge area 17 of forming section 1 and in its simplest form is in the embodiment of a sensor. The desired value is processed in a control and/or regulating device 8 and is set by controlling at least one dewatering unit, preferably at least the dewatering unit En−1 which is located directly prior to the last dewatering unit En. For this purpose control and/or regulating device 8 is linked with the adjustment device or adjustment devices 9.1 through 9.*n*−1 of the individual dewatering units E1 through En−1 which is located inside forming section 1 in direction of travel of fibrous stock suspension FS prior to the last dewatering unit En. Depending on the current actual value these are preferably regulated as a function of the target dry content $X_{desired}$–$TG_{target}$ that is to be achieved so that the actual value $X_{actual}$–$TG_{target}$ is consistent with desired value $X_{desired}$–$TG_{target}$. The control occurs in such a way that the drainage capacity of dewatering unit En−1 which is located prior to dewatering unit En and after immobility point IP, or respectively at the additional prior dewatering units E4 through En−1, is reduced, so that a respectively lower dry content is set at the discharge of these individual dewatering units E4 through En−1 than when the drainage capacities at the individual dewatering units E4 through En−1 are fully utilized. The individual dewatering units E4 through En−1 which are located after immobility point IP and prior to last dewatering unit En hereby act as control elements in a control system 4 of target dry content $TG_{target}$.

FIG. 1*b* shows an example of input and output values at the control and/or regulating device 8 allocated to forming section 1. Input value X is for example at least the desired value for the target dry content $X_{desired}$–$TG_{target}$ which is to be achieved, in an adjustment also the actual value $X_{actual}$–$TG_{target}$. By maintaining the conditions at the last dewatering unit En, especially the adjustment of the maximum drainage capacity through controlling control element 9.*n* allocated to it by creating an appropriate control variable Y9.*n*, additional control variables Y9.4 and/or Y9.*n*−1 are determined and control elements 9.4 and/or 9.*n*−1 activated.

Figure 2A:
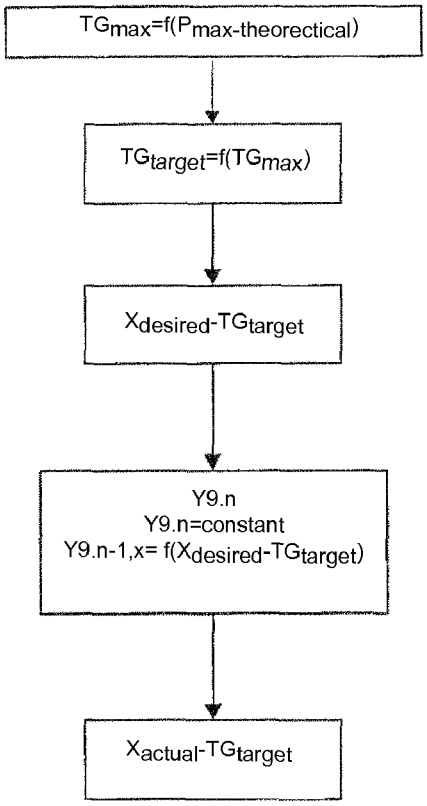
FIG. 2*a* is a signal flow diagram of a method for controlling the dry content.

FIG. 2*a* shows the basic principle of the inventive method with the assistance of a signal flow diagram. It shows the knowledge or respectively the determination of the maximum dry content $TG_{max}$ which is achievable inside forming section 1 with the available dewatering units E1 through En, in combination in application under optimum utilization of the theoretically available drainage capacity $P_{max\text{-}theoretical}$. Depending on the maximum stock-dependent dry content $TG_{max}$ which is theoretically achievable under line conditions a targeted dry content $TG_{target}$ is predetermined for operation of forming section land is established as a function of $TG_{max}$. As already mentioned this is consistent with a value which deviates from the actual theoretically possible dry content $TG_{max}$ in a range of 0.1 to 5%, preferably 0.1 to 3%, especially preferably 0.1 to 2%. The target dry content $TG_{target}$ is lower here than the maximum dry content $TG_{max}$.

In addition the target dry content $TG_{target}$ is set as the desired value $X_{desired}$–$TG_{target}$ of a control, preferably an adjustment. FIG. 2*a* only shows an example of the control. Depending upon the determined or preset desired values $X_{desired}$–$TG_{target}$ activation occurs of at least one of the last dewatering units En−1 through En-x of forming section 1, located prior to dewatering unit En and thereby preset control variables Y9.*n*−1, $x=f(X_{desired}-TG_{target})$, whereby x is consistent with the maximum number of dewatering units E inside compression zone VZ.

Figure 2B:
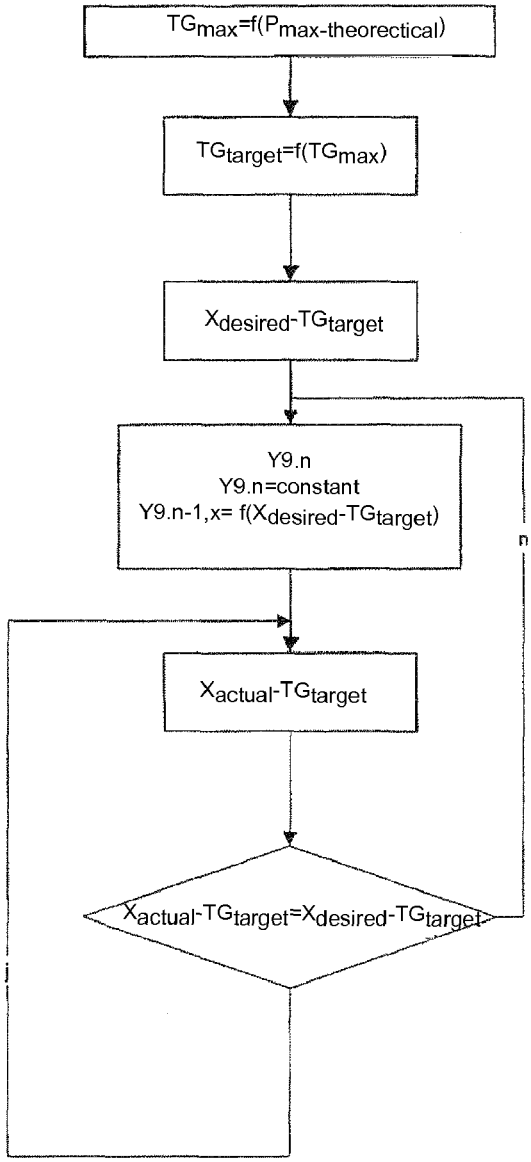
FIG. 2*b* is a signal flow diagram of a method for regulating the dry content.

FIG. 2*b* illustrates the integration of the inventive controls into a regulating system, whereby the actual value $X_{actual}$–$TG_{target}$ is continuously determined besides the predetermined desired value $X_{desired}$–$TG_{target}$ and the individual control variables Y9.*n*−1, x are formed for actuating the dewatering units En−1 through En-x which are located prior to the last dewatering unit. The last dewatering unit En in direction of travel is operated at the maximum possible drainage capacity. The control variable Y9.*n* remains constant for the control; in other words, it remains unchanged or respectively is determined according to the maximum capacity. Because of the continuous comparison the drainage behavior on dewatering units En−1, x which are located prior to the last dewatering unit can be controlled and regulated in such a way that their drainage capacities are lowered and, by utilizing the maximum theoretical possible drainage capacity, the maximum possible drainage effect is achieved with the last dewatering unit En.

Figure 3A:
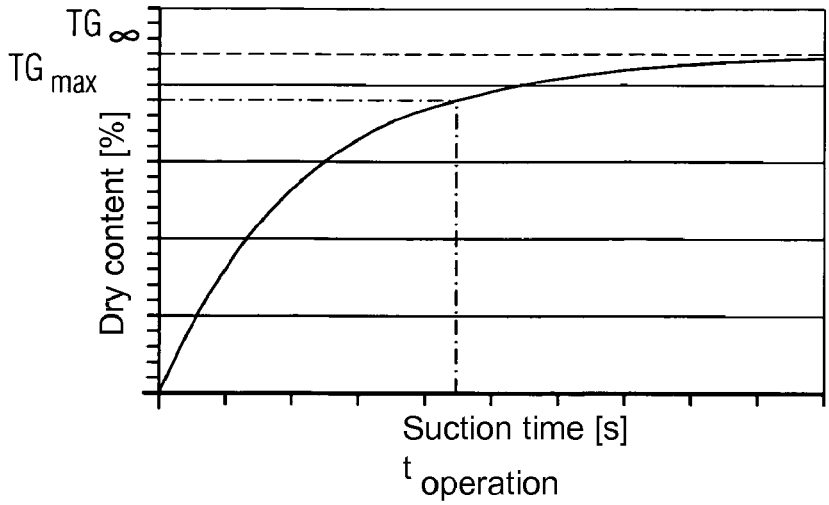
FIGS. 3*a* and 3*b* are diagrams which clarify the functional mode of the inventive solution.

Here the inventors have made use of the knowledge that—with predetermined vacuum strength on one of the dewatering units E in the embodiment of suction devices—the dry content development in the sheet compression zone and thereby the drainage effect can be described through an exponential function. For the dewatering unit E this is as follows and is shown as an example in the form of a diagram in FIG. 3*a*:

$$TG_{E\text{-}out}=TG_{E\text{-}in}+(TG_{\infty}-TG_{E\text{-}in})\times(1-e^{-t_{suction}\times k})$$

$TG_{E\text{-}out}$ outgoing dry content at dewatering unit E;

$TG_{E\text{-}in}$ incoming dry content at dewatering unit E;

$TG_{\infty}$ theoretically achievable stock-dependent dry content at one dewatering element with infinite reaction time, especially suction time;

k stock constant; and $t_{suction}$ suction time at the viewed dewatering unit E.

Starting from a low incoming dry content $TG_{E\text{-}in}$ at the respectively viewed dewatering unit E, the dry content TG of fibrous stock suspension FS, or respectively the fibrous web F, increases rapidly. Due to the exponential characteristic of the drainage behavior the increase in the drainage intensity however increasingly decreases—meaning, the dry content increase per time interval becomes less. Dry content TG then comes closer asymptotically in its progression to the theoretically achievable absolute dry content $TG_{\infty}$ at this dewatering unit E after infinite drying time, especially suction time. This is consistent with dry content $TG_{\infty}$ which is achieved at infinite suction time at the individual dewatering units. Changes in the incoming dry content $TG_{E\text{-}in}$ therefore have no substantial effect on the outgoing dry content $TG_{E\text{-}out}$. For practical purposes however, an infinite reaction time and thereby drying time cannot be realized. In the current state of the art the individual dewatering unit is therefore operated at maximum drainage capacity whereby a theoretical maximum dry content $TG_{max}$ is achieved over the operational duration $t_{operation}$ which is consistent with the reaction time. The inventors recognized that the behavior can be utilized to optimum effect in order to operate the entire described line more effectively and especially more energy efficiently, whereby a lower than the maximum theoretically achievable dry content $TG_{max}$ is set as the target dry content $TG_{target}$ which is consistent with a still acceptable minimum dry content at the discharge from forming section 1. This is controlled, preferably adjusted.

Figure 3B:
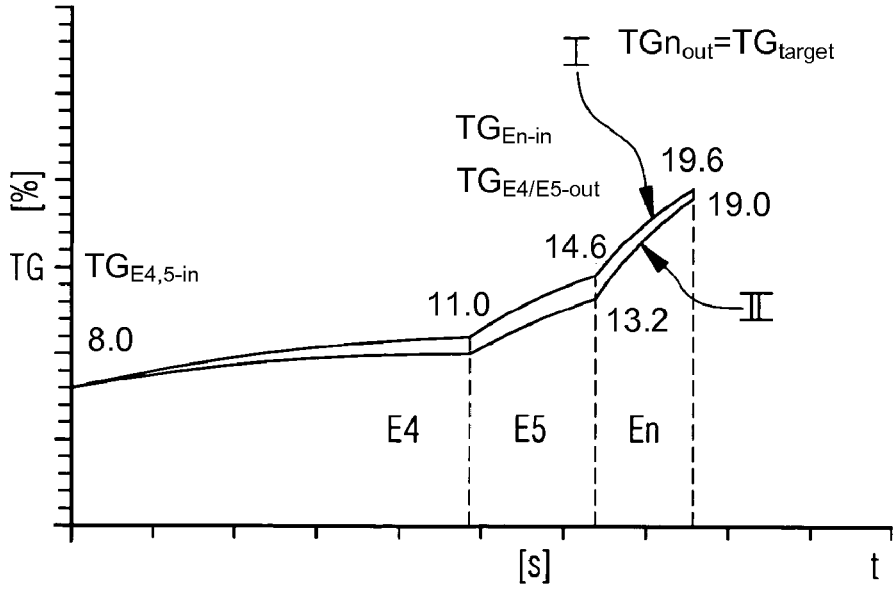

The dry content/time dependency diagram in FIG. 3*b* illustrates a specific example of a dry content development in a forming section 1 inside a sheet compression zone VZ, comprising for example a twin zone suction couch roll in the embodiment of a combined dewatering unit with a subsequent dewatering unit E in the embodiment of a high vacuum suction box. The individual suction zones of the suction couch roll are described as dewatering units E4 and E5. Travel speed of fibrous web F is for example 2,000 m/min. Dry content $TG_{E4,5\text{-}in}$ prior to the suction couch roll with the individual suction zones E4, E5 is a constant 8%. When applying the respective maximum vacuum at dewatering units E4, E5, for example operated in the first zone with 30 kPa and in the second zone with 60 kPa, an outgoing dry content $TG_{E4,E5\text{-}out}$ of 14.6% results according to characteristic curve I. With dewatering unit En in the embodiment of a high vacuum suction box which is operated for example at 65 kPa and therefore at maximum capacity a dry content of 19.6% is achieved. This dry content $TG_{En\text{-}out}$ is consistent with the achievable stock-dependent maximum dry content $TG_{max}$ under operational conditions at the discharge of forming section 1. Here, 19% is set for the inventive adjustment for a minimum dry contact to maintain a stable operation and thereby a target dry content $TG_{target}$. The characteristic curve resulting from this is identified as II in the diagram. At the same incoming dry content $TG_{E4,5\text{-}in}$ of 8% the capacity can be reduced at dewatering units E4 and E5. The vacuum strength in the first zone and thereby at E4 is 25 kPa, at the second dewatering unit E5 it is 55 kPa. The achievable outgoing dry content $TG_{E4,E5\text{-}out}$ and therefore the incoming dry content $TG_{En\text{-}in}$ at dewatering unit En reduces to 13.3% as opposed to I. The strong decrease of the dry content at the suction couch roll is partially compensated through the following dewatering unit En. At the same capacity the drainage capacity increases at En and in addition enables better lubrication between wire belt and dewatering unit En.

Figure 4A:
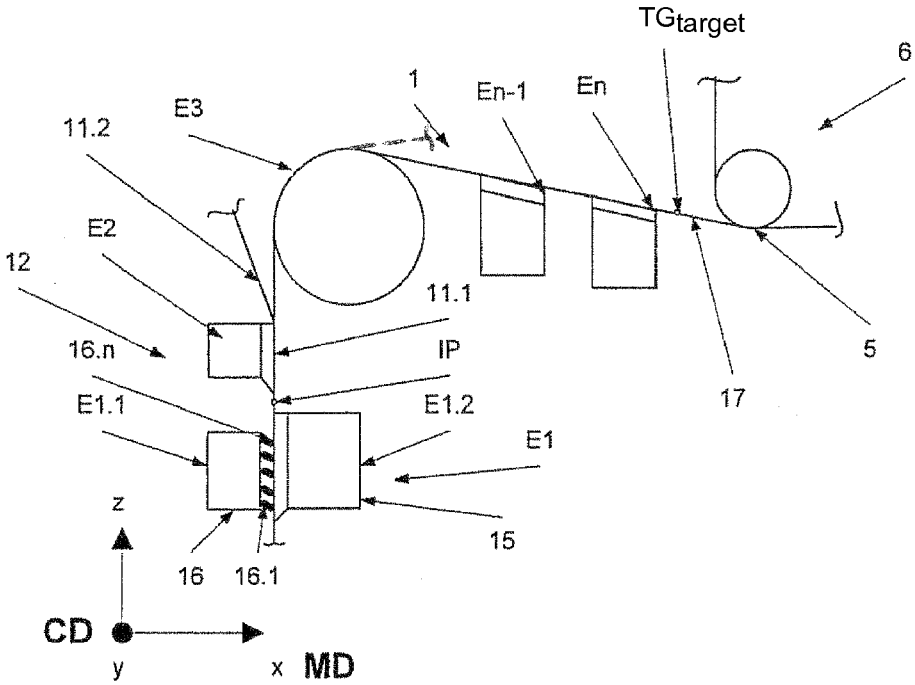
FIGS. 4*a* and 4*b* are segments of examples of possible configurations of a forming section following the immobility point, with suitability for application of the inventive method.
Figure 4B:
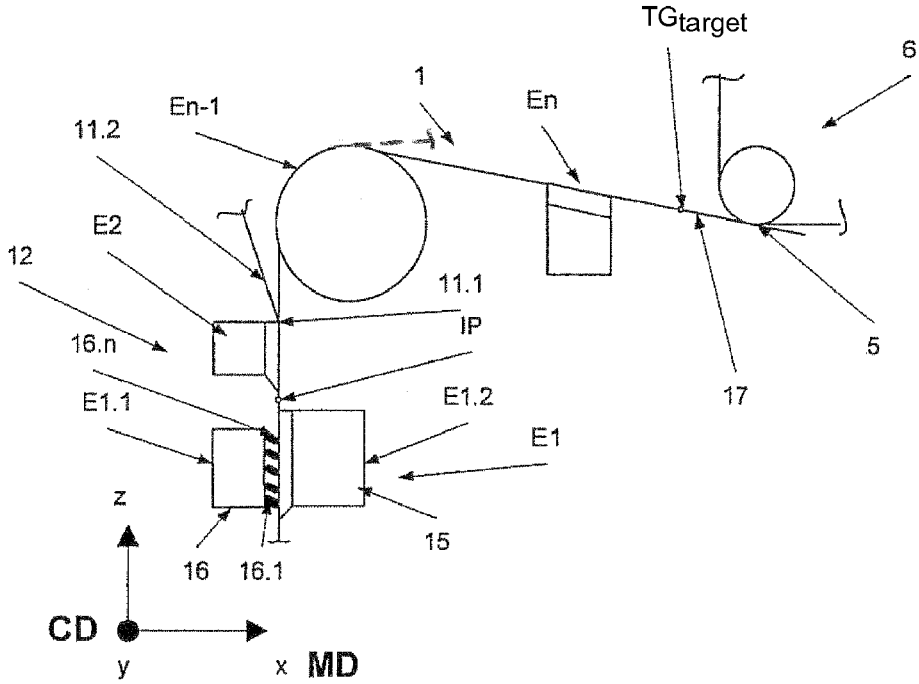

Partial views of a forming section 1 FIGS. 4*a* and 4*b* illustrate examples of arrangements of the individual dewatering elements E1 through En, of the immobility point IP as well as the measuring point for the target dry content $TG_{target}$. Seen in FIG. 4*a* in a partial view of a twin wire zone 12 is dewatering unit E1 consisting of two dewatering units E1.1 and E1.2 which become effective on both sides of wires 11.1, 11.2 located opposite each other and carrying the fibrous stock suspension FS, whereby one of the two dewatering units E1.1, E1.2 is in the embodiment of a dewatering chest to which vacuum can be applied and the other dewatering unit E1.2 is equipped with elastic forming blades 16.1 through 16.*n* which become effective on the side of wire 11.2 facing away from the side which carries fibrous stock suspension FS. They serve to apply pressure impulses into fibrous stock suspension FS. After passing through dewatering unit E1 the immobility point IP is reached and the fibrous web F ensuing from fibrous stock suspension FS is being drained by individual additional dewatering units E2 in the embodiment of a suction device, E3 in the embodiment of a suction couch roll as well as En−1 in the embodiment of a suction device and the last suction device En located in direction of travel. In order to set the target dry content $TG_{target}$, the drainage behavior at the individual dewatering elements E2 and/or E3 and/or En−1 can be controlled in order to achieve a lower incoming dry content at the entry into the last dewatering element En.

FIG. 4*b* in contrast illustrates one design according to FIG. 4*a* whereby dewatering element En−1 was foregone. Here, control occurs essentially over dewatering unit En−1 in the embodiment of a suction couch roll which is located prior to the now last dewatering unit En.

Figure 5A:
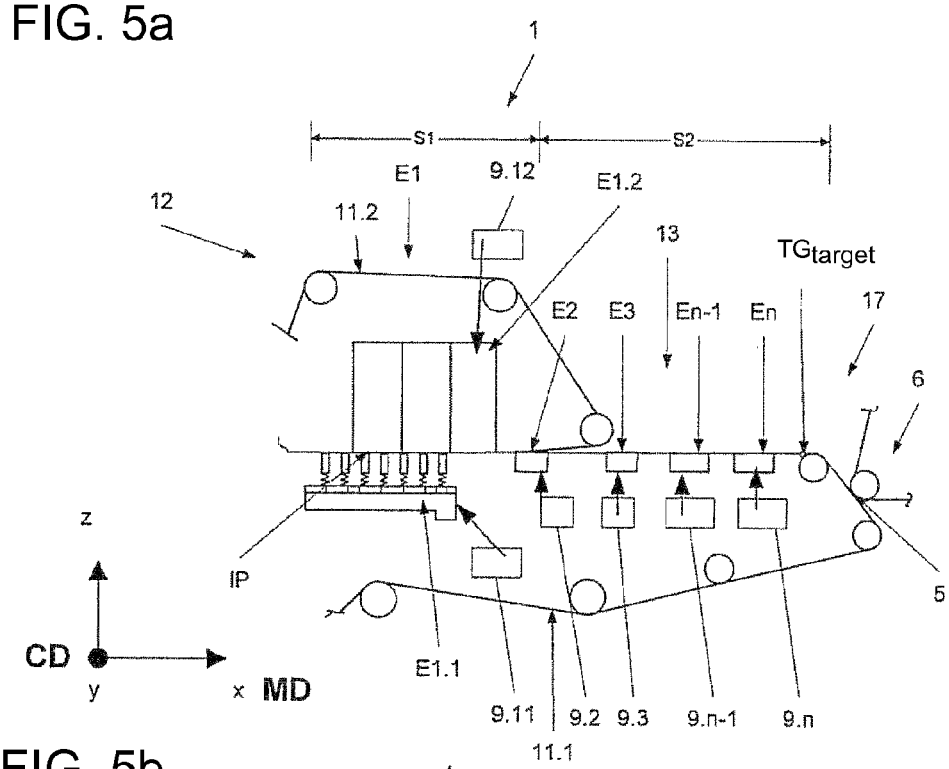
FIGS. 5*a* and 5*b* are segments of examples of possible additional configurations of a forming section following the immobility point, with suitability for application of the inventive method.

FIG. 5*a* clarifies a segment from a forming section 1 with twin wire zone 12 and following after-dewatering zone 13, whereby twin wire zone 12 is illustrated at least partially, comprising here also a dewatering unit E1 from an upper dewatering unit E1.2 and dewatering unit E1.1 located in the lower wire 11.1 and equipped with blade type elements 16.1 through 16.*n* to deliver pressure impulses into fibrous stock suspension FS which is being carried between the two continuous revolving wires 11.1 and 11.2. Inside dewatering segment S1 which is formed by twin wire zone 12, a dewatering unit E2 in the embodiment of a suction device follows. Dewatering units E3, En−1 and En with their control elements 9.3, 9.*n*−1 and 9.*n* are located inside the following dewatering segment S2 in the embodiment of an after-dewatering zone 13. Control of the dewatering behavior occurs predominantly through the control of dewatering unit En−1 and/or E3 and/or E2.

Figure 5B:
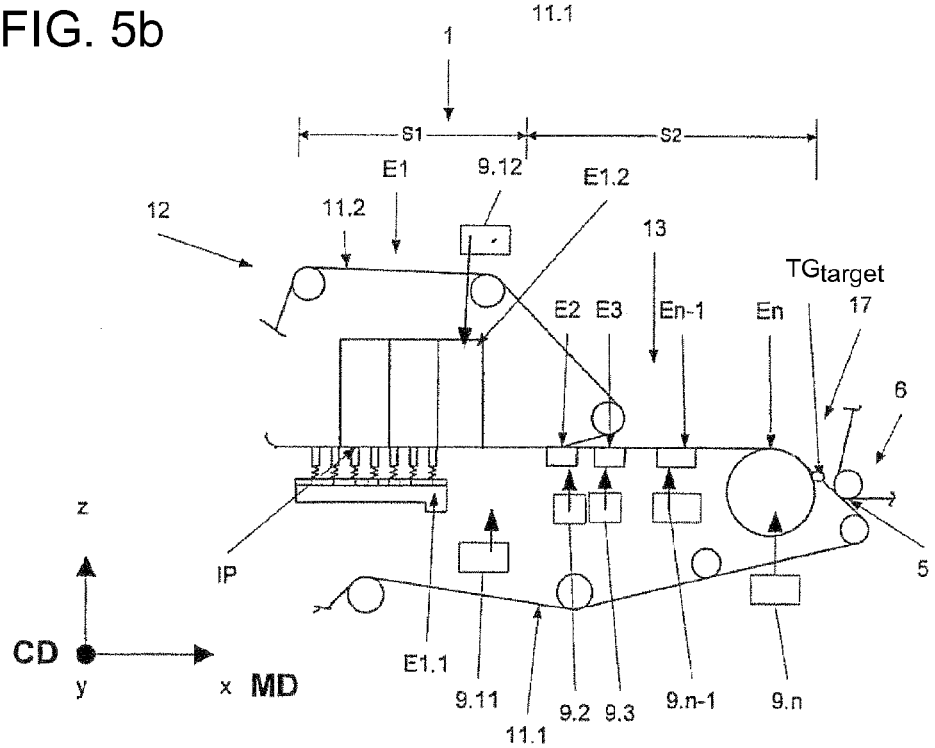

FIG. 5*b* in contrast clarifies an alternative variation of a twin wire zone 12 where, following dewatering unit E1 from E1.2 in the embodiment of a dewatering chest 15 and E1.1 in the embodiment of a forming box 16 a suction device is located in wire 11.1 comprising two suction zones which form dewatering units E2, E3; as well as dewatering unit En−1 located at a distance to these in the fibrous stock carrying wire 11.1 after separation of the two wires 11.1, 1.2; and subsequently a suction couch roll as dewatering unit En. In order to achieve the target dry content $TG_{target}$ after the last dewatering element En in the embodiment of the suction couch roll the incoming dry content in this location is controlled by controlling the dewatering behavior at least at one of the individual dewatering elements E2 through En−1.

Figure 6A:
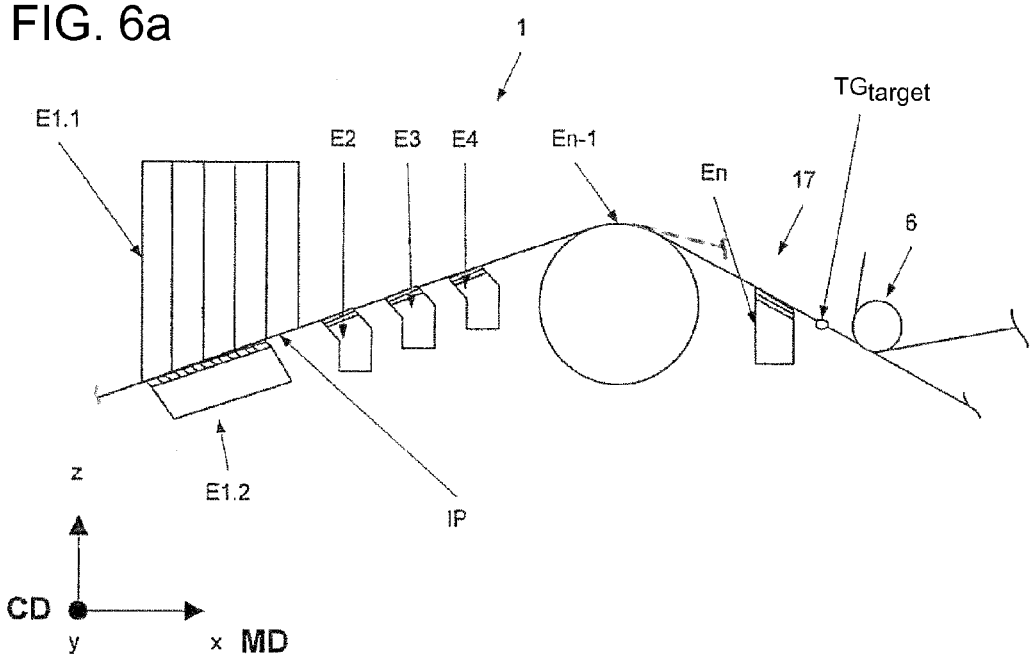
FIGS. 6*a* and 6*b* are segments of examples of possible third configurations of a forming section following the immobility point, with suitability for application of the inventive method.
Figure 6B:
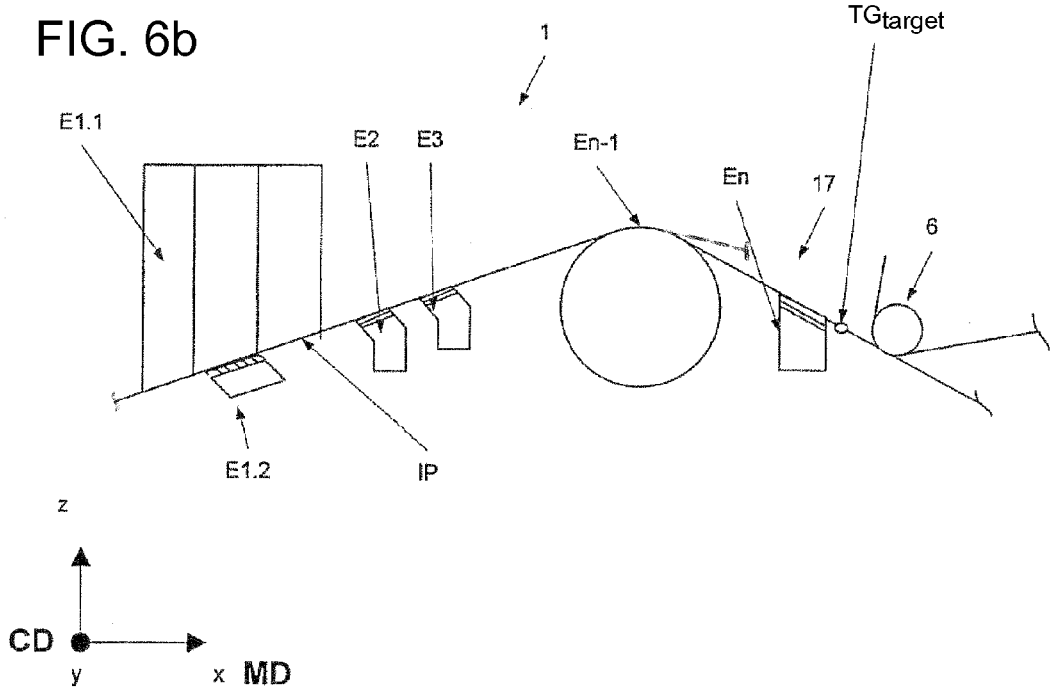

FIGS. 6*a* and 6*b* illustrate examples of additional variations of a forming section 1, comprising a dewatering unit E1.1 in the embodiment of a vacuum equipped top wire suction chest, as well as a dewatering unit E1.2 located on the lower wire, and following dewatering elements E2 through En which are located at a distance from each other, whereby E2 through E4 are formed by individual suction devices, whereas En−1 is in the embodiment of a suction roll and En again is formed by a suction device. FIG. 6*b* illustrates an alternative layout with fewer dewatering units E2 and E3 in contrast to FIG. 6*a*, whereby dewatering unit E1.2 incorporates a different number of suction zones.

Figure 7A:
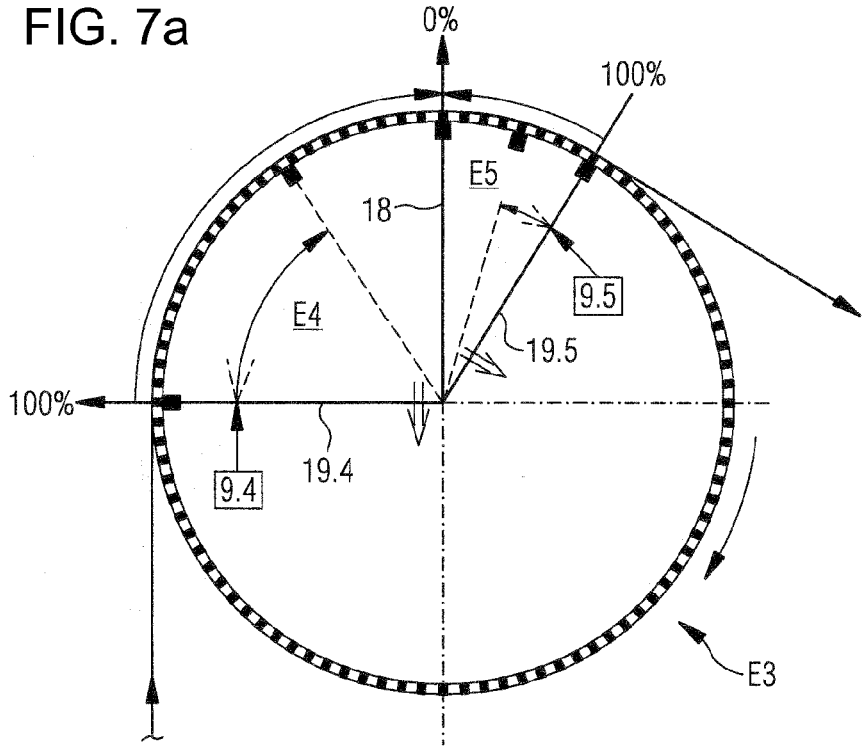
FIG. 7*a* is a schematic sectional view of a first design variation of a dewatering unit in the embodiment of a suction couch roll for the for the inventive forming section.

FIG. 7*a* is a schematic sectional view of a first design form of a dewatering unit E3 in the embodiment of a suction couch roll for the inventive forming section 1 which is illustrated and described in FIGS. 4*a*, 4*b*, 6*a* and 6*b*.

The illustrated suction couch roll which is well known to the expert shows two suction zones—merely as an example—which are identified as E4 and E5, as supported by FIG. 3*b*. It can, of course, also have more than two suction zones. The two immediately adjacent suction zones E4 and E5 are separated from each other by a primary separation wall 18. Segregation between the respective suction zone E4 and E5 occurs by means of a movable secondary separation wall 19.4 and 19.5. If the respective secondary separation wall 19.4 and 19.5 is located in its end position, then each of the two suction zones E4 and E5 have an open area of 100%. Moving (arrow) the respective secondary separation wall 19.4 and 19.5 allows adjustment of the respective open area of the individual suction zones E4 and E5 in a range from 100% to 0%. Movement (arrow) of the respective secondary separation wall 19.4 and 19.5 can occur in a known manner by means of a respective control element 9.4 and 9.5 which can be activated by a control and/or regulating device. Merely for the purpose of the example the two secondary separation walls 19.4 and 19.5 are depicted by a broken line even after a movement, whereby the first suction zone E4 then still displays an open area of approx. 30% and the second suction zone E5 still displays an open area of approx. 50%.

Figure 7B:
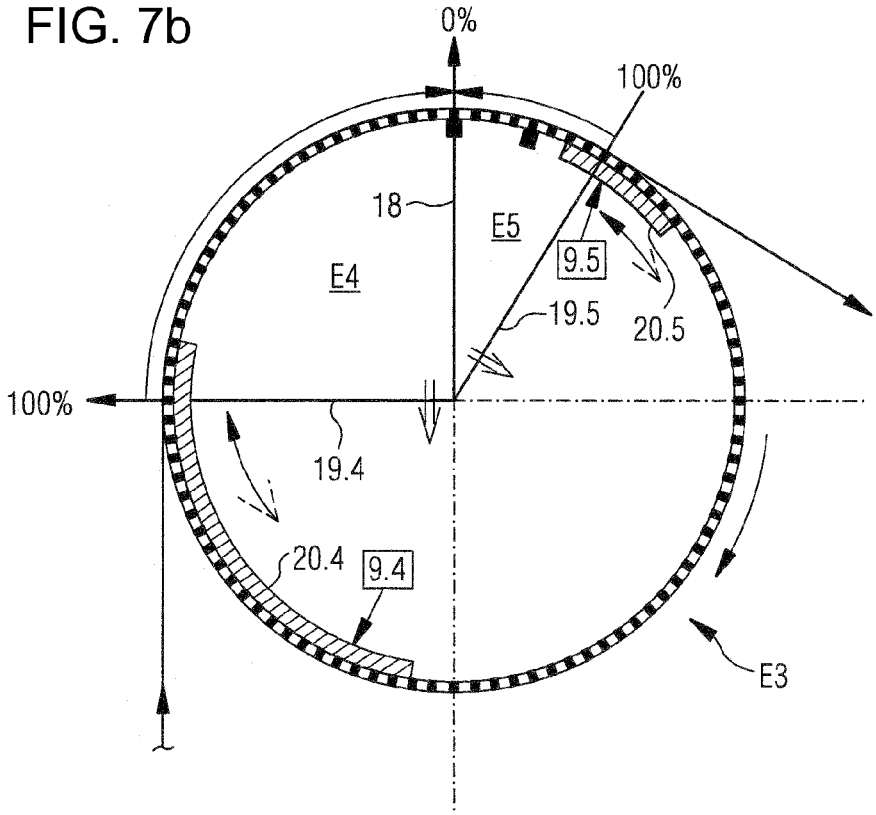
FIG. 7*b* is a schematic sectional view of a second design variation of a dewatering unit in the embodiment of a suction couch roll for the inventive forming section.

FIG. 7*b* is a schematic sectional view of a second design form of a dewatering unit E3 in the embodiment of a suction couch roll for the inventive forming unit 1 which is illustrated and described in FIGS. 4*a*, 4*b*, 6*a* and 6*b*.

The illustrated suction couch roll which is well known to the expert shows two suction zones—merely as an example—which are identified as E4 and E5, as supported by FIG. 3*b*. It can, of course, also have more than two suction zones. The two immediately adjacent suction zones E4 and E5 are separated from each other by a primary separation wall 18. Segregation between the respective suction zone E4 and E5 occurs by means of a movable secondary separation wall 19.4 and 19.5. The respective suction zone E4 and E5 displays an open area of 100%. In addition, a cover plate 20.4 and 20.5 respectively is provided for each of the two suction zones E4 and E5 by means of which the open area of the respective suction zone E4 and E5 can be reduced to 0%. The individual cover plate 20.4 and 20.5 is located movably (arrow) inside the respective suction zone E4 and E5. Movement (arrow) of the respective cover plate 20.4 and 20.5 can occur in a known manner by means of a respective control element 9.4 and 9.5 which can be activated by a control and/or regulating device.

Figure 8A:
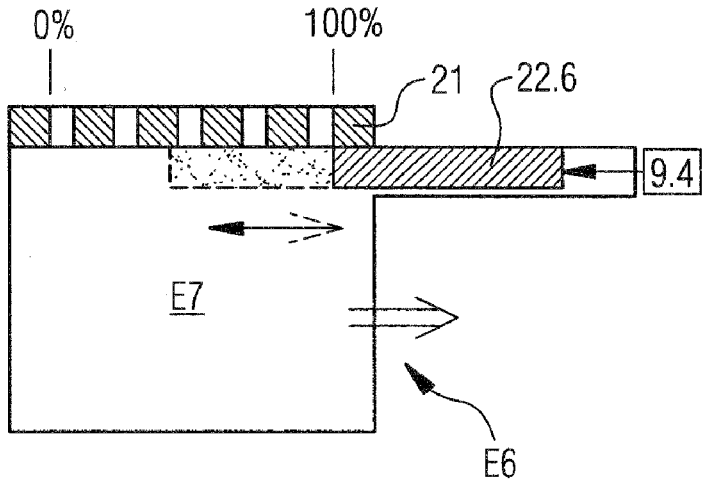
FIG. 8*a* is a schematic sectional view of a first design variation of a dewatering unit in the embodiment of a high vacuum suction box for the inventive forming section.

FIG. 8*a* is a schematic sectional view of a first design variation of a dewatering unit E6 in the embodiment of a high vacuum suction box for the inventive forming section 1 which is illustrated and described in FIGS. 1*a*, 4*a*, 4*b*, 5*a*, 5*b*, 6*a* and 6*b*.

The illustrated high vacuum suction box which is well known to the expert includes—merely as an example—a suction zone E7 which is equipped with a covering 21 on its top and which is in contact with the guided wire. Suction box cover 21 may comprise holes, slots or may be structured open as desired and has a maximum open surface of 100%. In addition a cover plate 22.6 is provided by means of which the open surface of the suction box cover 21 can be reduced to 0%. Cover plate 22.6 is located movably (arrow) inside the respective suction zone E7. Movement (arrow) of cover plate 22.6 occurs in a known manner by means of a control element 9.4 which can be activated by a control and/or regulating device.

Figure 8B:
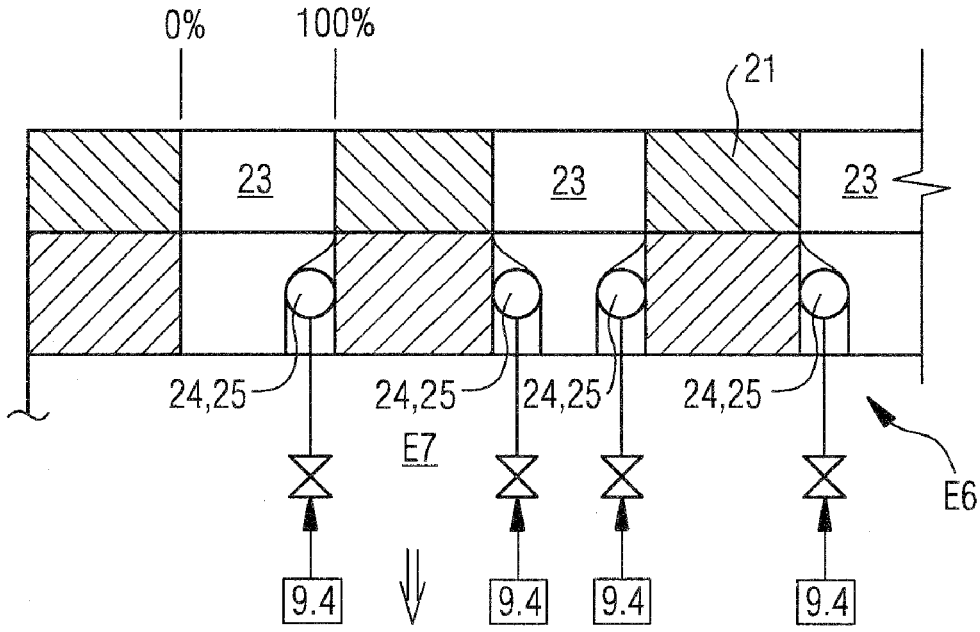
FIG. 8*b* is a schematic sectional view of a second design variation of a dewatering unit in the embodiment of a high vacuum suction box for the inventive forming section.

FIG. 8*b* is a schematic sectional view of a second design variation of a dewatering unit E6 in the embodiment of a high vacuum suction box for the inventive forming section 1 which is illustrated and described in FIGS. 1*a*, 4*a*, 4*b*, 5*a*, 5*b*, 6*a* and 6*b*.

The illustrated high vacuum suction box which is well known to the expert includes—merely as an example—a suction zone E7 which is equipped with a covering 21 on its top and which is in contact with the guided wire. Suction box cover 21 may comprise holes, slots or may be structured open as desired and has a maximum open surface of 100%. In addition at least one means 24 are provided for each opening 23 of the suction cover to reduce the open areas. This may be in the embodiment of a diaphragm 25 which can be activated by means of a control element 9.4 which can be activated by a control and/or regulating device. The open surface of the suction box cover 21 can be reduced to 0% through means 24.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Forming section
2 Machine for the production of fibrous webs
3 Headbox
4 Control-/regulating system
5 Transfer section
6 Press section
7 Device for at least indirect acquisition of a value describing the dry content at least indirectly
8 Control and/or regulating device
9.1-9.*n* Control element
9.4 Control element
9.5 Control element
10 Pre-dewatering zone
11.1, 11.2 Wire
12 Twin wire zone
13 After-dewatering zone
14 Breast roll
15 Dewatering chest
15.1, 15.2 Suction zone
16 Forming box
16.1-16.*n* Forming blades
17 Discharge area
18 Primary separation wall
19.4 Secondary separation wall
19.5 Secondary separation wall

20.4 Cover plate
20.5 Cover plate
21 Vacuum box covering
22.6 Cover plate
23 Opening
24 Means
25 Diaphragm
CD Direction transversely to machine direction
E1-E5, En−1, En Dewatering unit
En.1.2, En-1.1, En−1, x Dewatering unit
E1.1, E1.2, E3.1, E3.2 Dewatering unit
E3 Dewatering unit (suction couch roll)
E4 Suction zone
E5 Suction zone
E6 Dewatering unit (high vacuum suction box)
E7 Suction zone
F Fibrous web
FS Fibrous stock suspension
IP Immobility point
k Stock constant
MD Machine direction
S1-S3 Dewatering segment
$t_{suction}$ Suction time at the described dewatering element E
$t_{operation}$ Reaction time at the described dewatering element E
$TG_{E\text{-}out}$ Outgoing dry content at one dewatering unit E
$TG_{E\text{-}in}$ Incoming dry content at one dewatering unit E
$TG_{En\text{-}in}$ Incoming dry content at one dewatering unit En
$TG_{E4,\,5\text{-}in}$ Incoming dry content at one dewatering unit E4, E5
$TG_{En\text{-}out}$ Outgoing dry content at one dewatering unit En
$TG_{E4,5\text{-}out}$ Outgoing dry content at one dewatering unit E4, E5
$TG_{max}$ Theoretically maximum achievable stock-dependent dry content in discharge area of forming section
$TGE_{\infty}$ theoretically achievable stock-dependent dry content at one dewatering element with infinite reaction time, especially suction time
$TG_{target}$ Target dry content in discharge area of the forming section
VZ Compression zone
$X_{desired}$−$TG_{target}$ Desired value target dry content in discharge area of forming section
$X_{actual}$−$TG_{target}$ Actual value target dry content in discharge area of forming section
Y1-Y4, Yn, Yn−1, x Control variable
X, Y, Z Coordinates

What is claimed is:

1. A forming section in a machine for producing a web of fibrous material, said forming section comprising:

at least one continuous rotating wire supporting a fibrous stock suspension at least indirectly;

a compression zone;

a plurality of dewatering units, at least two of said plurality of dewatering units being one of located in series and respectively located following each other in a direction of travel of said fibrous stock suspension inside said compression zone; and a control and/or regulating system including:

a control and/or regulating device;

at least one device for at least indirectly acquiring a value at least indirectly characterizing a dry content of the web in a transfer area from the forming section to a following function unit, said control and/or regulating device being linked with at least one said device for at least indirectly acquiring said value at least indirectly characterizing said dry content of the web in said transfer area from the forming section to said following function unit;

a device for input of a desired value for a target dry content, said control and/or regulating device being linked with said device for input of said desired value for said target dry content;

a plurality of control elements, said control and/or regulating device being linked at least indirectly with one of (a) said plurality of control elements of individual ones of said plurality of dewatering units which are located prior to one of a plurality of last ones of said plurality of dewatering units, and (b) one of said plurality of control elements of a last one of said plurality of dewatering units inside said compression zone, said control and/or regulating system being configured for controlling said target dry content by reducing an incoming dry content on one of a last three ones of said plurality of dewatering units viewed in a direction of travel of said fibrous stock suspension inside said compression zone; and a device for creating a plurality of control variables for controlling respectively individual ones of said plurality of dewatering units.

2. The forming section according to claim 1, wherein said control and/or regulating device is linked with said plurality of control elements of individual ones of said plurality of dewatering units.

3. The forming section according to claim 1, wherein at least one of said plurality of dewatering units is formed as one of (a) a suction device; (b) a forming box with at least one suction zone and a plurality of forming blades which are one of fixed and subject to pressing contact; (c) a plurality of forming blades; and (d) a curved dewatering element.

4. The forming section according to claim 3, wherein said suction device is one of a fixed suction device and a rotating suction couch roll.

* * * * *